US005199647A

United States Patent [19]

Yoshizu

[11] Patent Number: 5,199,647

[45] Date of Patent: Apr. 6, 1993

[54] FUEL INJECTION NOZZLE

[75] Inventor: Fumitsugu Yoshizu, Saitama, Japan

[73] Assignee: Zexel Corporation, Tokyo, Japan

[21] Appl. No.: 803,587

[22] Filed: Dec. 9, 1991

[30] Foreign Application Priority Data

Dec. 21, 1990 [JP] Japan ..... 2-404075[U]

[51] Int. Cl.[5] ..... F02M 61/18; B05B 1/26

[52] U.S. Cl. ..... 239/533.12; 239/543

[58] Field of Search ..... 239/533.2-533.14, 239/543-548

[56] References Cited

U.S. PATENT DOCUMENTS 1,494,020 5/1924 Riehm ..... 239 X/543

FOREIGN PATENT DOCUMENTS 65282 11/1982 European Pat. Off. ..... 239/533.8
467724 10/1928 Fed. Rep. of Germany ..... 239/533.12
2434339 1/1975 Fed. Rep. of Germany ... 239/533.4
1214595 12/1970 United Kingdom ..... 239/533.12
2223270 4/1990 United Kingdom ..... 239/533.4

*Primary Examiner*—Andres Kashnikow
*Assistant Examiner*—Kevin P. Weldon
*Attorney, Agent, or Firm*—Fish & Richardson

[57] ABSTRACT

There is disclosed a fuel injection nozzle which can change a fuel injection direction in accordance with a fuel injection amount. A plurality of pairs of first and second injection ports are formed in a distal end portion of a nozzle body, and are spaced from one another in the direction of the periphery of the nozzle body. The angle of the first injection port relative to the axis of the nozzle body is acute, and is smaller than the angle between the second injection port and the axis of the nozzle body. Inner ends of the first injection ports are disposed at a valve seat, and inner ends of the second injection ports are spaced from the inner ends of the first injection ports toward the distal end of the nozzle body. Each pair of first and second injection ports have a substantially common outer end. When a tapered conical abutment portion of a needle valve is seated on the valve seat, the inner ends of the first injection ports face the out peripheral surface of the abutment portion.

7 Claims, 3 Drawing Sheets

FUEL INJECTION NOZZLE

BACKGROUND OF THE INVENTION

This invention relates to a fuel injection nozzle for injecting fuel, fed under pressure from a fuel injection pump, into a combustion chamber of an engine.

For example, as disclosed in Japanese Laid-Open Patent Application No. 1-92569, a fuel injection nozzle comprises an elongated hollow nozzle body having a closed lower end, and a needle valve mounted within the nozzle body. This nozzle body includes a fuel reservoir chamber, a tapered valve seat formed on the inner surface of the lower end portion of the nozzle body, and a plurality of injection ports formed in the lower end portion of the nozzle body. The inner ends of these injection ports are disposed at the valve seat of the nozzle body. The needle valve has a pressure receiving portion exposed to the fuel reservoir chamber, and a tapered conical abutment portion formed at its lower end portion. The needle valve is urged by a spring, so that its abutment portion is seated on the valve seat. In this seated condition, the inner ends of the injection ports are closed by the outer peripheral surface of the abutment portion. The pressure of fuel fed into the fuel reservoir chamber from a fuel injection pump acts on the pressure receiving portion to cause the needle valve to lift against the bias of the spring, so that the abutment portion is brought out of contact with the valve seat. As a result, the injection ports are opened to inject the fuel into a combustion chamber of an engine.

In the above fuel injection nozzle, the plurality of injection ports are classified into a first group and a second group. The first injection ports slanting downward are disposed at an acute angle relative to the axis of the nozzle body, and the second injection ports are disposed generally perpendicularly to the axis of the nozzle body. The fuel injection nozzle is mounted on the engine in inclined relation to the axis of an engine cylinder, and therefore it is expected that all of the injection ports are inclined at generally the same angle relative to the axis of the engine cylinder.

The above fuel injection nozzle can not fully satisfy the following two requirements which are necessary for further enhancing a combustion efficiency and for reducing the production of hydrocarbon and so on.

The first requirement is to vary the angle of injection of the fuel in accordance with the engine load, that is, the amount of injection of the fuel. When the engine load is small, so that the fuel injection amount is small, the temperature of the wall surface of the combustion chamber is low. If the fuel is caused to deposit on an inner surface of a cylinder head (which constitutes part of the combustion chamber) by a stream produced upon upward movement of a piston, the vaporization of the fuel is delayed, which causes the production of hydrocarbon and so on. Therefore, when the load is small, the fuel is required to be injected obliquely downward. On the other hand, when the load is large, the fuel is required to be injected generally laterally over a wide range.

Reference is made to the reason why the above fuel injection nozzle can not satisfy the first requirement. When the fuel injection nozzle is disposed in inclined relation to the axis of the engine cylinder, with all the fuel injection ports inclined at generally the same angle relative to the axis of the engine cylinder, the directions of injection of the fuel from the fuel injection ports are generally equal, and therefore in this case, it is clear that the first requirement can not be satisfied.

Let's consider the case where the fuel injection nozzle is disposed parallel to the axis of the engine cylinder. The inner ends of the first and second injection ports are disposed in a common plane perpendicular to the axis of the nozzle body. Therefore, when the needle valve lifts, the pressure at the inner ends of the first injection ports is equal to the pressure at the inner ends of the second injection ports, and the fuel is injected from both of the first and second injection ports regardless of the amount of lift of the needle valve (that is, regardless of the value of the load). Thus, the direction of the fuel injection can not be varied in accordance with the load. Particularly, in the above fuel injection nozzle, the direction of injection of the fuel from the second injection ports in the low-load condition is lateral, and therefore the fuel tends to deposit on the low-temperature inner surface of the cylinder head.

The second requirement is to make the fuel particles as fine as possible so as to easily vaporize the fuel. In the above fuel injection nozzle, the outer ends of the first injection ports are spaced apart from the outer ends of the second injection ports, and therefore the effect (later described) of making the fuel particles fine, as achieved in the present invention, can not be attained, and it is thought that its fuel particle size is generally the same as that achieved with conventional fuel injection nozzles.

Japanese Laid-Open Utility Model Application No. 62-87171 discloses a fuel injection nozzle comprising a nozzle body and a needle valve. The nozzle body has a tapered valve seat formed on an inner surface of a lower end portion thereof, and a small chamber provided below this valve seat. A single first injection port and a plurality of second injection ports are formed in the lower end portion of the nozzle body, and the angle of inclination of the first injection port is different from that of the second injection ports. When the fuel injection nozzle is slightly obliquely mounted on an engine, the first injection port extends generally horizontally, and the second injection ports extend obliquely downward. The inner end of the first injection port is disposed at the valve seat, and the inner ends of the second injection ports are disposed at the inner peripheral surface of the small chamber. The needle valve has at its lower end portion a tapered conical abutment portion and a throttle portion formed at the lower end of this abutment portion. When the abutment portion is seated on the valve seat, the throttle portion is extended into the above small chamber. In this seated condition, the inner end of the first injection port is closed by the outer peripheral surface of the abutment portion, and the inner ends of the second injection ports are closed by the outer peripheral surface of the throttle portion. When the needle valve lifts, the abutment portion is brought out of contact with the valve seat at an initial stage at which the lift is small, so that the first injection port is opened, thereby injecting the fuel from the first injection port toward an ignition plug. At this initial stage, the throttle portion remains received in the small chamber, and therefore the second injection ports are kept closed. When the needle valve further lifts, the throttle portion comes out of the small chamber, so that the second injection portions are opened, thereby injecting the fuel from the second injection ports.

In the fuel injection nozzle of the above Japanese Laid-Open Utility Model Application No. 62-87171, the fuel is injected laterally from the first injection port when the amount of lift of the needle valve is small, and therefore this fuel injection nozzle can not meet the above first requirement, as is the case with the fuel injection nozzle of the above Japanese Laid-Open patent application No. 1-92569. Further, since the outer ends of all the injection ports are spaced part from one another, the above second requirement can not be satisfied.

Japanese Laid-Open Utility Model Application No. 57-158972 discloses a fuel injection nozzle similar to the fuel injection nozzle of the above Japanese Laid-Open Utility Model Application No. 62-87171. This fuel injection nozzle has first and second injection ports which are inclined at the same angle. When the lift of a needle valve is small, fuel is injected from the first injection port, and when the lift is large, the fuel is injected from the first and second injection ports. In this fuel injection nozzle, the direction of the fuel injection is not changed regardless of the amount of lift of the needle valve, and therefore the above first requirement can not be satisfied. Further, since the outer ends of all the injection ports are spaced apart from one another, the above second requirement can not also be satisfied.

Technology Reports of Tohoku University (Vol. 22, No. 2, pages 157 to 164, issued Mar. 25, 1958; Editor: Engineering Department of Tohoku University; Publisher: Tohoku University) discloses a fuel injection nozzle comprising a nozzle body and a needle valve. The nozzle body has an equalizer chamber at its lower end portion, and a valve seat provided above this equalizer chamber. A plurality of pairs of first and second injection ports are formed in the lower portion of the nozzle body, and are spaced circumferentially of the nozzle body. The first injection ports extend obliquely downward relative to the axis of the nozzle body, and the second injection ports extend perpendicularly to the axis of the nozzle body. The inner ends of the first injection ports are disposed above the inner ends of the second injection ports. The inner ends of the first and second injection ports are open to the equalizer chamber. Each pair of first and second injection ports have a common outer end. In this fuel injection nozzle, since the inner ends of the first and second injection ports are open to the equalizer chamber, the fuel is injected from the first and second injection ports when the needle valve lifts, so that the fuel can be injected at a wide angle. However, the pressures at the inner ends of the first and second injection ports are equal to each other, and the fuel is injected from the first and second injection ports, and therefore the direction of injection of the fuel can be not selected in accordance with the load (the amount of the fuel injection), and the above first requirement can not be satisfied. Further, since the first and second injection ports have the common outer end, no pressure difference occurs at this common outer end, and therefore a cavitation is not produced, and it can not be expected to make the fuel particles fine. Therefore, the above second requirement can not be satisfied.

SUMMARY OF THE INVENTION

It is an object of this invention to provide a fuel injection nozzle which can change the direction of injection of fuel in accordance with the amount of injection of the fuel, and can make the fuel particles fine, thereby improving a combustion efficiency and suppressing the production of hydrocarbon and etc more effectively.

According to the present invention, there is provided a fuel injection nozzle comprising:

(a) a hollow elongated nozzle body having a closed distal end, the nozzle body having a fuel reservoir chamber intermediate the opposite ends thereof, a tapered valve seat formed on an inner surface of the distal end portion of the nozzle body, and a plurality of pairs of first and second injection ports formed in the distal end portion of the nozzle body and spaced from one another in a direction of the periphery of the nozzle body, the angle of the first injection port relative to an axis of the nozzle body being acute and smaller than the angle of the second injection port relative to the axis of the nozzle body, inner ends of the first injection ports being disposed at the valve seat, inner ends of the second injection ports being spaced from the inner ends of the first injection ports toward the distal end of the nozzle body in the direction of the axis of the nozzle body, and each pair of the first and second injection ports having a substantially common outer end;

(b) a needle valve received in the nozzle body, the needle valve having a pressure receiving portion disposed in opposed relation to the fuel reservoir chamber, and a tapered conical abutment portion formed forwardly of the pressure receiving portion, and the inner ends of the first injection ports facing an outer peripheral surface of the abutment portion when the abutment portion of the needle valve is seated on the valve seat; and (c) spring means for urging the needle valve so as to cause the abutment portion to be seated on the valve seat, a pressure of fuel in the fuel reservoir chamber acting on the pressure receiving portion to urge the needle valve against the bias of the spring means, thereby disengaging the abutment portion from the valve seat.

DESCRIPTION OF THE PREFERRED EMBODIMENTS

Preferred embodiments of the present invention will now be described with reference to the drawings.

Figure 1:
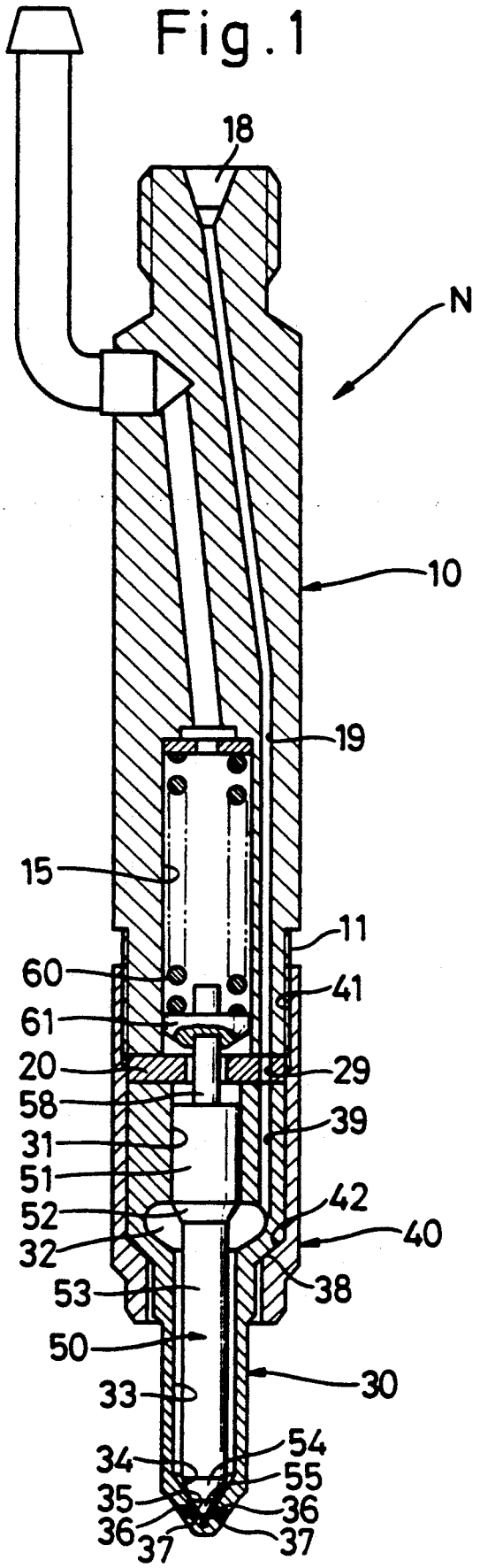
FIG. 1 is a vertical cross-sectional view of a fuel injection nozzle according to the present invention.

As shown in FIG. 1, a fuel injection nozzle N includes an elongated nozzle holder 10, a disk-shaped spacer 20, and an elongated nozzle body 30 which are arranged in this order toward the lower end of the nozzle N. The nozzle body 30 is supported on the nozzle holder by a tubular retainer 40. More specifically, an externally-threaded portion 11 is formed on the outer periphery of the lower end portion of the nozzle holder 10. An internally-threaded potion 41 is formed on the inner periphery of the upper end portion of the retainer 40, and the inner periphery of the retainer 40 is stepped adjacent to the lower end thereof to provide a tapered surface 42. The outer periphery of the nozzle body 30 is stepped intermediate the opposite ends thereof to provide a tapered surface 38. The nozzle body 30 is inserted into the retainer 40, and in this condition the internally-threaded portion 41 is threadedly engaged with the externally-threaded portion 11 of the nozzle holder 10, so that the nozzle body 30 is supported on the nozzle holder 10 coaxially therewith. In this supported condition, the spacer 20 is firmly held between the lower surface of the nozzle holder 10 and the upper surface of the nozzle body 30, and the tapered surface 42 of the retainer 40 is firmly abutted against the tapered surface 38 of the nozzle body 30. Thus, the nozzle holder 10, the spacer 20, the nozzle body 30 and the retainer 40 cooperate with one another to form one body.

The nozzle body 30 is of an elongated tubular shape, and has a closed lower end. The nozzle body 30 has a guide hole 31, a fuel reservoir chamber 32, a fuel passage hole 33, and a tapered hole 34 which are arranged in this order toward the lower end of the nozzle body 30. The fuel passage hole 33 is smaller in diameter than the guide hole 31, and is coaxially therewith. The fuel reservoir chamber 32 is connected to a fuel inlet 18, formed in the upper end surface of the nozzle holder 10, via a fuel passage 39, formed longitudinally in the nozzle body 30, a fuel passage 29, formed through the spacer 20, and a fuel passage 19 formed longitudinally in the nozzle holder 10. The fuel inlet 18 is connected to a fuel injection pump (not shown) via a pipe.

A needle valve 50 is received within the nozzle body 30. The needle valve 50 has a slide portion 51, a pressure receiving portion 52, an extension portion 53, a first tapered portion 54, and a second tapered portion 55 which are arranged in this order toward the lower end of the nozzle body 30 in coaxial relation to one another. The extension portion 53 is smaller in diameter than the slide portion 51, and the pressure receiving portion 52 is tapered. The slide portion 51 is received in the guide hole 31 of the nozzle body 30 so as to slide in its axial direction. The pressure receiving portion 52 is exposed to the fuel reservoir chamber 32 of the nozzle body 30, and receives a pressure of the fuel reservoir chamber 32. The extension portion 53 is received in the fuel passage hole 33 of the nozzle body 30, and a gap between the outer peripheral surface of the extension portion 53 and the inner peripheral surface of the fuel passage hole 33 serves as a fuel passage. The first and second tapered portions 54 and 55 are received in the tapered hole 34 of the nozzle body 30.

Figure 2:
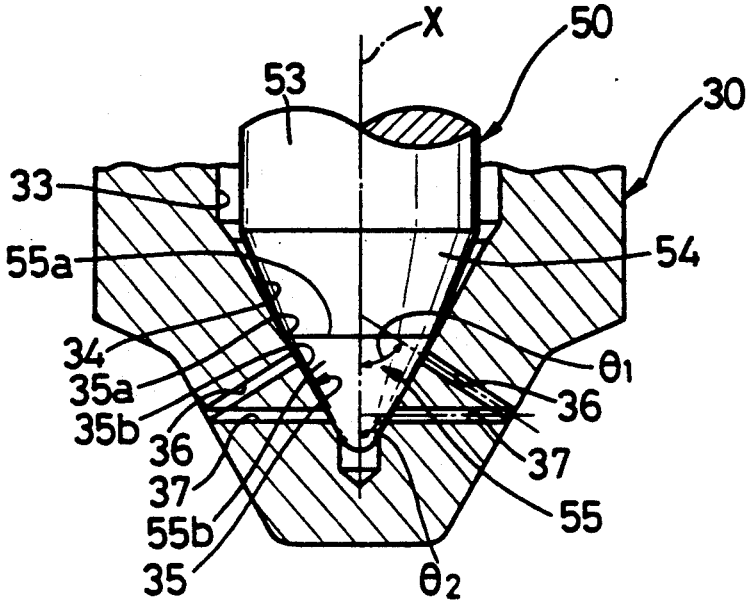
FIG. 2 is an enlarged cross-sectional view of a lower end portion of the fuel injection nozzle.

As best shown in FIG. 2, the angle of tapering of the second tapered portion 55 of the needle valve 50 is very slightly larger (for example, about 10 minutes) than, and generally equal to the tapering angle of the tapered hole 34. Therefore, the second tapered portion 55 can be brought into surface-to-surface contact with the inner periphery surface of the tapered hole 34 under the influence of a spring 60 (later described) in such a manner that the second tapered portion 55 is slightly deformed resiliently. Hereinafter, the second tapered portion 55 will be referred to as "abutment portion". The tapering angle of the first tapered portion 54 is smaller than the tapering angle of each of the abutment portion 55 and the tapered hole 34, and therefore the first tapered portion 54 will not be in contact with the inner peripheral surface of the tapered hole 34. That portion of the abutment portion 55 disposed at the boundary between the abutment portion 55 and the first tapered portion 54 is most strongly contacted with the inner peripheral surface of the tapered hole 34, and therefore serves as a main abutment portion **55*a*. That portion lying below the main abutment portion 55*a* serves as a sub-abutment portion 55*b*. That annular portion of the inner peripheral surface of the tapered hole 34 against which the abutment portion 55 is abutted serves as a valve seat 35. That portion of the valve seat 35 against which the main abutment portion 55*a* is abutted serves as a main seat portion 35*a*. That portion of the valve seat 35 against which the sub-abutment portion 55*b* is abutted serves as a sub-seat portion 35*b***.

As shown in FIG. 1, the needle valve 50 is urged downward by the spring 60, so that the abutment portion 55 is abutted against the valve seat 35. The spring 60 is received in a receiving hole 15 formed in the lower portion of the nozzle holder 10, and acts on the needle valve 50 via a spring receiver 61 and a projection 58 formed on the upper end of the needle valve 50.

Next, a feature of the present invention will be described with reference to FIG. 2. A plurality of (for examples, 10) pairs of first and second injection ports 36 and 37 are formed in the lower end portion of the nozzle holder 30, and are spaced from one another in the circumferential direction. Each pair of first and second injection ports 36 and 37 are disposed at the same angular position in the direction of the circumference of the nozzle body 30. The angle $\theta_1$ between the axis X of the nozzle body 30 and the first injection port 36 is smaller than the angle $\theta_2$ between the axis X and the second injection port 37. Specifically, in this embodiment, the angle $\theta_1$ is an acute angle (about 60°), and the angle $\theta_2$ is about 90°. The inner ends of first injection ports 36 and the inner ends of the second injection ports 37 are disposed at the valve seat 35, and are spaced from each other in the direction of the axis of the nozzle body 30. More specifically, the inner end of the first injection port 36 is disposed above the inner end of the second injection port 37. The inner ends of all of the first injection ports 36 are disposed in a common plane perpendicular to the axis of the nozzle body 30, and also the inner ends of all of the second injection ports 37 are disposed in a common plane perpendicular to the axis of the nozzle body 30. Each pair of first and second injection ports 36 and 37 have a substantially common outer end. All of these common outer ends are disposed in a common plane perpendicular to the axis of the nozzle body 30.

Figure 3:
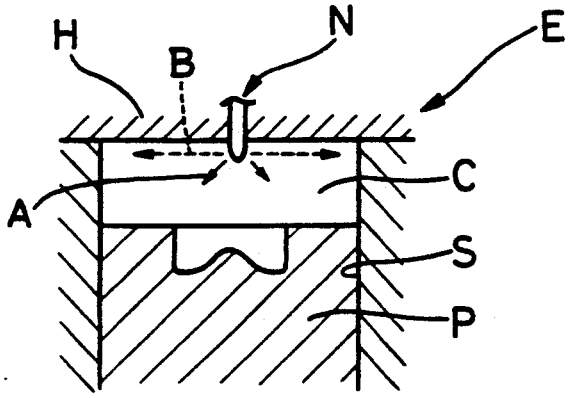
FIG. 3 is a schematic cross-sectional view showing the fuel injection nozzle as mounted on an engine.

The fuel injection nozzle N of the above construction is mounted on an engine E in a manner shown in FIG. 3. In this embodiment, the fuel injection nozzle N is disposed parallel to axes of a cylinder S and a piston P.

Fuel is intermittently fed under pressure to the fuel injection nozzle N of the above construction from the fuel injection pump. When the fuel under pressure is not supplied, the needle valve 50 is urged downward by the spring 60, so that the abutment portion 55 of the needle valve 50 is seated on the valve seat 35 in surface-to-surface contacted relation. In this condition, the inner ends of the injection ports 36 and 37 face the outer peripheral surface of the abutment portion 55, and therefore are closed by this outer peripheral surface.

When the fuel is supplied under pressure from the fuel injection pump, the pressure of the fuel reservoir chamber 32 increases, and this pressure acts on the pressure receiving portion 52 to lift the needle valve 50, so that the abutment portion 55 of the needle valve 50 is brought out of contact with the valve seat 35. At this time, the fuel, flowed from the fuel reservoir chamber 32 via the fuel passage hole 33, is injected into a combustion chamber C of the engine E from either the injection ports 36 and the injection ports 37. The direction of injection of the fuel is changed by a throttling effect in the clearance between the outer peripheral surface of the abutment portion 55 and the inner peripheral surface of the valve seat 35. This will be described in detail in the following.

When the engine load is small, so that the amount of supply of the fuel from the fuel injection pump is small, the amount of lift of the needle valve 50 is small. In this case, the clearance between the outer peripheral surface of the abutment portion 55 and the inner peripheral surface of the valve seat 35 is small, and therefore the fuel resides in this clearance, and is injected from the first injection ports 36. In other words, because of a pressure loss due to the throttling effect at this clearance, the pressure of the inner ends of the first injection ports 36 is higher than the pressure of the inner ends of the second injection ports 37, and therefore the first injection ports 36 are selected for fuel injection, and the fuel injection from the second injection ports 37 is not effected. Therefore, the fuel is injected obliquely downward from the lower end portion of the nozzle N into the combustion chamber C, as indicated by arrow A in FIG. 3. Therefore, the fuel is not caused to deposit on a surface of a cylinder head H by a stream produced upon upward movement of the piston P, and even when the temperature of the surface of the cylinder head H is low, the vaporization of the fuel can be effected satisfactorily. And besides, since the fuel is injected obliquely downward, the injected fuel can be directed to the vicinity of the central portion of the combustion chamber, and despite the small fuel injection amount, a proper mixture ratio of the fuel to the air can be obtained locally. As a result, the combustion efficiency can be enhanced, and also the production of hydrocarbon can be suppressed.

When the load of the engine E increases, the amount of supply of the fuel from the fuel injection pump is increased, so that the amount of lift of the needle valve 50 increases. In this case, at an initial stage of the lift of the needle valve 50, the clearance between the outer peripheral surface of the abutment portion 55 and the inner peripheral surface of the valve seat 35 is small, and therefore the fuel is injected obliquely downward from the first injection ports 36, as described above. When the needle valve 50 further lifts more than a predetermined amount, the above clearance is increased. Therefore, the fuel passes through this clearance, and tends to reside in the lower end portion of the nozzle body 30. At this time, because of a Venturi effect due to the passage of the fuel through this clearance, the pressure of the inner ends of the first injection ports 36 becomes lower than the pressure of the inner ends of the second injection ports 37. As a result, the fuel injection is switched to the second injection ports 37, and the fuel is injected laterally from the lower end portion of the nozzle body 30 as indicated by arrow B in FIG. 3, thereby distributing the fuel over a wide area. When the fuel injection amount is thus large, the fuel is distributed over a wide area to thereby optimize the mixture ratio of the fuel and the air to enhance the combustion efficiency, and also the generation of smoke and etc., can be suppressed.

In the foregoing, the explanation has been made in a simplified manner; however, strictly speaking, it is thought that as the amount of lift of the needle valve 50 increases, the fuel injection angle increases from $\theta_1$ toward $\theta_2$.

Further, due to the pressure difference between the inner ends of the first injection ports 36 and the inner ends of the second injection ports 37, a pressure difference between those portions of the first and second injection ports 36 and 37 near their common outer end also develops. Due to this pressure difference, a cavitation develops in the fuel at the common outer end. This cavitation is rapidly expanded when the fuel is injected into the combustion chamber C from the common outer end, thereby efficiently making the fuel particles fine. As a result, the vaporization of the fuel is promoted, and the combustion efficiency is enhanced, and the generation of hydrocarbon and smoke can be suppressed.

The present invention is not limited to the above embodiment, and suitable modifications can be made without departing from the scope of the invention. Those portions of the following embodiments corresponding to those of the above embodiment are designated by identical reference numerals, respectively, and detailed explanation thereof will be omitted.

Figure 4:
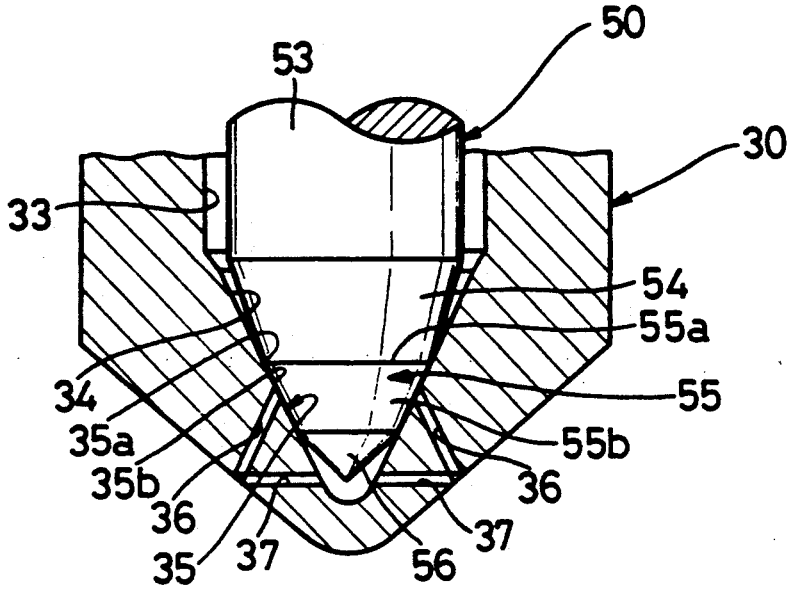
FIGS. 4 and 5 are views similar to FIG. 2, but showing modified fuel injection nozzles, respectively.

In the embodiment shown in FIG. 4, a nozzle body 30 has a tapered hole 34, a valve seat 35 defined by part of the inner peripheral surface of the tapered hole 34, first injection ports 36, and second injection ports 37. A needle valve 50 has a slide portion (not shown), a pressure receiving portion (not shown), an extension portion 53, a first tapered portion 54, a second tapered portion (abutment portion) 55, and a third tapered portion 56. The relation of the tapering angle between the first tapered portion 54, the abutment portion 55 and the valve seat 35 is the same as described in the above embodiment. The tapering angle of the third tapered portion 56 is much larger than that of the valve seat 35. In this embodiment, only the inner ends of the first injection ports 36 are disposed at the valve seat 35, and these inner ends are closed by the outer peripheral surface of the abutment portion 55 when the needle valve 50 is seated on the valve seat 35. The angle between the first injection port 36 and the axis of the nozzle body 30 is smaller than that described above for the preceding embodiment, and is about 20°. The inner end of each second injection port 37 is open to the inner surface of the tapered hole 34 adjacent to the lower end thereof, and is spaced downwardly from the valve seat 35. In the seated condition of the needle valve 50, the second injection ports 37 are not closed by the outer peripheral surface of the abutment portion 55.

Figure 5:
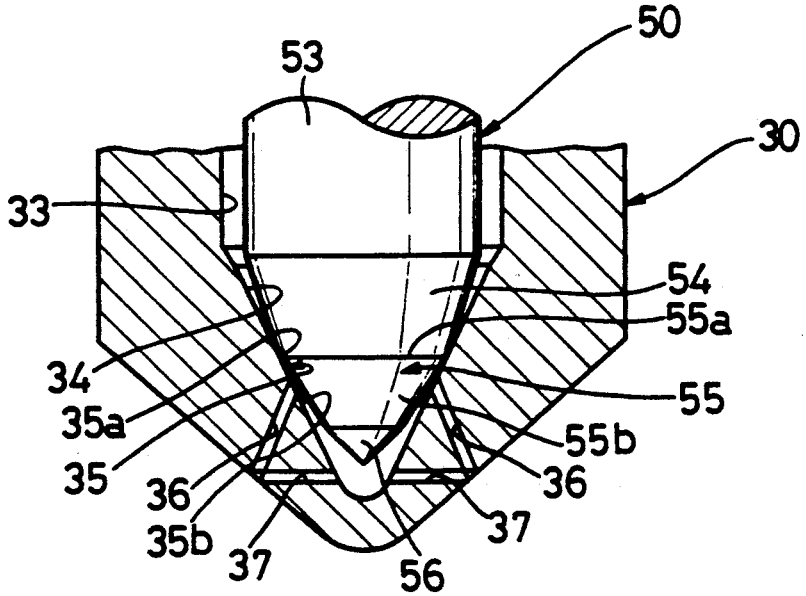

In the embodiment shown in FIG. 5, a tapering angle of an abutment portion 55 of a needle valve 50 is slightly larger than a tapering angle of a valve seat 35, and only a main abutment portion **55*a* of the abutment portion 55 is in contact with a main seat portion 35*a* of the valve seat 35 along a circular line. In FIG. 5, the difference in the tapering angle between the two is shown in an exaggerated manner. In this embodiment, a sub-seat portion 35*b* of the valve seat 35 is spaced very slightly from a sub-abutment portion 55*b* of the abutment portion 55. Inner ends of first injection ports 36 are disposed at the sub-seat portion 35*b*, and are not completely closed by the outer peripheral surface of the abutment portion 55 of the needle valve 50**.

When the fuel injection nozzle is designed to be mounted on the engine in oblique relation to the axis of the cylinder, the angles of inclination of the pairs of first and second injection ports are different from one another. Namely, the angles of inclination of one pair of first and second injection ports relative to the axis of the nozzle body are the maximum, whereas the angles of inclination of that pair of first and second injection ports disposed in diametrically opposite relation to the one pair of first and second injection ports are the minimum. In this case, the common outer ends of the pairs of first and second injection ports may be disposed in a common plane perpendicular to the axis of the piston. Preferably, the inner ends of all of the first injection ports are disposed in a common plane perpendicular to the axis of the nozzle body. Similarly, the inner ends of all of the second injection ports are preferably disposed in a common plane perpendicular to the axis of the nozzle body.

The angle of each of the second injection ports relative to the axis of the nozzle body may be acute.

What is claimed is:

1. A fuel injection nozzle comprising:

(a) a hollow elongated nozzle body having a closed distal end, said nozzle body having a fuel reservoir chamber intermediate the opposite ends thereof, a tapered valve seat formed on an inner surface of a distal end portion of said nozzle body, and a plurality of pairs of first and second injection ports formed in the distal end portion of said nozzle body spaced from one another in a direction from an axis of said nozzle body, the angle of said first injection port relative to the axis of said nozzle body being acute and smaller than the angle of said second injection port relative to the axis of said nozzle body, inner ends of said first injection ports being disposed at said valve seat, inner ends of said second injection ports being spaced from the inner ends of said first injection ports toward the distal end of said nozzle body in the direction of the axis of said nozzle body, and each pair of said first and second injection ports having a substantially common outer end;

(b) a needle valve received in said nozzle body, said needle valve having a pressure receiving portion disposed in opposed relation to said fuel reservoir chamber, and a tapered conical abutment portion formed forwardly of said pressure receiving portion, and the inner ends of said first injection ports facing an outer peripheral surface of said abutment portion when said abutment portion of said needle valve is seated on said valve seat; and (c) spring means for urging said needle valve so as to cause said abutment portion to be seated on said valve seat, wherein pressure within said fuel reservoir chamber causes said pressure receiving portion to urge said needle valve against the bias of said spring means, thereby disengaging said abutment portion from said valve seat.

2. A fuel injection nozzle according to claim 1, in which the angle of tapering of said valve seat is substantially equal to the angle of tapering of said abutment portion of said needle valve, whereby in the seated condition of said needle valve, the inner ends of said first injection ports are closed by the outer peripheral surface of said abutment portion.

3. A fuel injection nozzle according to claim 1, in which the inner ends of said second injection ports are disposed at said valve seat, whereby when said abutment portion of said needle valve is seated on said valve seat, the inner ends of said second injection ports face the outer peripheral surface of said abutment portion.

4. A fuel injection nozzle according to claim 3, in which the angle of tapering of said valve seat is substantially equal to the angle of tapering of said abutment portion of said needle valve, the inner ends of said second injection ports being disposed at said valve seat, whereby in the seated condition of said needle valve, the inner ends of said second injection ports are closed by the outer peripheral surface of said abutment portion.

5. A fuel injection nozzle according to claim 1, in which when said abutment portion of said needle valve is abutted against said valve seat, the inner ends of said second injection ports are spaced from a distal end of said abutment portion in the direction of the axis of said nozzle body.

6. A fuel injection nozzle according to claim 1, in which the inner ends of said first injection ports are disposed in a common plane perpendicular to the axis of said nozzle body, the inner ends of said second injection ports being disposed in a common plane perpendicular to the axis of said nozzle body.

7. A fuel injection nozzle according to claim 1, in which each pair of said first and second injection ports are disposed at the same angular position.

* * * * *